United States Patent [19]

Handkammer

[11] 4,159,732

[45] Jul. 3, 1979

[54] METHOD OF CASTING

[76] Inventor: Herbert K. Handkammer, 76 Guinions Rd., High Wycombe, Buckinghamshire, England

[21] Appl. No.: 805,713

[22] Filed: Jun. 13, 1977

[30] Foreign Application Priority Data

Jun. 11, 1976 [GB] United Kingdom ..... 24286/76

[51] Int. Cl.[2] ..... B22C 9/20; B22D 33/04

[52] U.S. Cl. ..... 164/137; 164/335; 164/339; 164/364

[58] Field of Search ..... 164/137, 409, 329, 330, 164/331, 339, 340, 341, 350, 351, 207, 213, 192, 324, 22, 187, 205, 210, 213, 335, 364; 214/6 H, 6 S, 10.5 R; 249/126, 137

[56] References Cited

U.S. PATENT DOCUMENTS

| | | | |
|---|---|---|---|
| 3,257,015 | 6/1966 | Annable et al. | 214/6 H |
| 3,463,221 | 8/1969 | Tillery | 164/350 |
| 3,517,728 | 6/1970 | Taccone | 164/339 X |
| 3,587,721 | 6/1971 | Feagin | 164/350 |
| 3,672,434 | 6/1972 | Grolla | 164/210 X |
| 3,709,282 | 1/1973 | Taccone | 164/187 |

*Primary Examiner*—Richard B. Lazarus
*Assistant Examiner*—John S. Brown
*Attorney, Agent, or Firm*—William R. Liberman

[57] ABSTRACT

A method of casting is provided which uses boxless moulds. The method comprises the steps of stacking a plurality of boxless moulds substantially horizontally on one another in a frame to form a substantially vertical stack, pivoting the frame with the moulds therein through an angle of approximately 90° so that each mould stands substantially vertically, and filling the moulds with molten metal while they are in the substantially vertical position.

6 Claims, 2 Drawing Figures

METHOD OF CASTING

This invention relates to a method of casting using boxless moulds.

According to the invention there is provided a method of casting comprising the steps of stacking a plurality of boxless moulds substantially horizontally on one another in a frame to form a substantially vertical stack, pivoting the frame with the moulds therein through an angle of approximately 90° so that each mould stands substantially vertically, and filling the moulds with molten metal while they are in the substantially vertical position.

An embodiment of the invention is shown in the accompanying drawings, in which.

Figure 1:
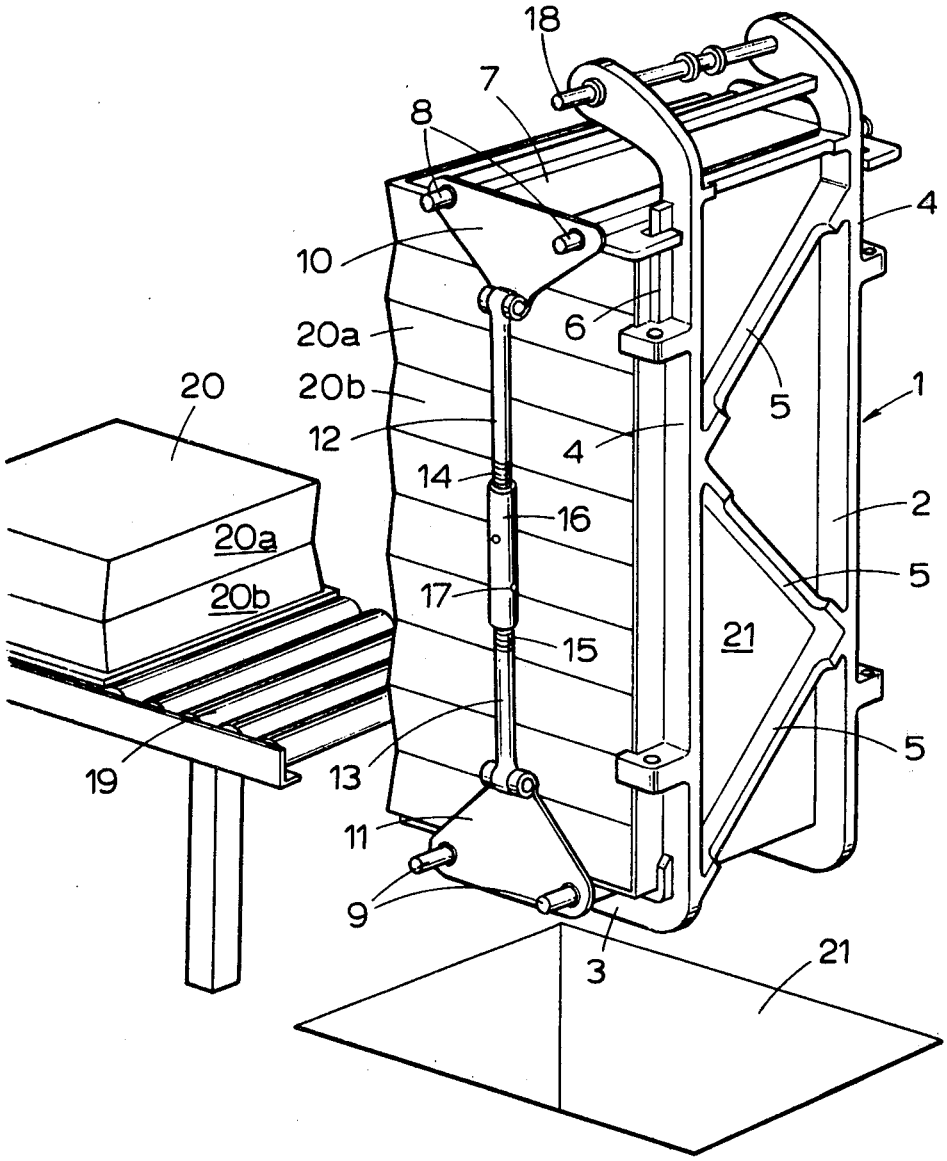
FIG. 1 is a perspective view of an apparatus for carrying out the present invention, with the moulds in a vertical pile prior to casting.

The illustrated apparatus comprises a frame 1. The frame 1 has an upright portion 2 curved over at its upper end and a base 3 extending integrally from the portion 2 at right angles thereto. The upright portion 2 has longitudinal side bars 4 and diagonal struts 5 extending therebetween. Adjacent their upper ends the side bars 4 are each provided with a flange 6 which is received in a corresponding slot in a plate 7 so as to permit vertical sliding movement of the plate with respect to the upright portion 2. Pins 8 and 9 are provided respectively on the lateral edges of the plate 7 and the base 3. Triangular, apertured plates 10 and 11 are slidably received on the pins 8 and 9. Rods 12 and 13 are each pivotally connected at one end to a respective one of the triangular plates and their opposite ends have screw-threaded portions 14 and 15 of opposite hand to one another. A connecting sleeve 16 is provided with internal threaded portions at opposite ends which engage the portions 14 and 15, and also has apertures 17 to enable the sleeve to be rotated. Parts similar to those with reference numerals 8 to 17 inclusive are provided on the opposite side of the frame (not visible in FIG. 1). However, on the other side of the frame the plates 10 and 11 need not be slidably removable from the base 3 and the plate 7, and may be held in position by pins 22 as indicated in FIG. 2. The curved over part of the upright portion is provided with an outwardly extending bar 18 which serves a purpose described below. The rear faces of the moulds rest against a back plate 21, for example of asbestos or steel, and similar plates may be provided on either side of the stack of moulds.

A roller conveyor 19 provides a path along which boxless moulds 20 are supplied to the frame 1. Each mould 20 comprises a pair of mould sections **20*a* and 20*b*** which together define a mould cavity.

The frame 1 is suspended over a pit 21 by chains, not shown, which pass around the bar 18 and are attached to a crane. Initially, the empty frame is positioned at a height such that the base 3 is at substantially the same level as the conveyor 19. Moulds are stacked in the frame, by an operator who transfers them from the conveyor to the frame. During stacking, the frame is lowered, preferably under control of the operator, stacking the moulds. This makes it possible for the top of the stack of moulds to remain at the same height throughout the formation of the stack, so that the moulds are always stacked at the same height. This can be used to avoid any need for the operator stacking the moulds to bend down to stack moulds at a low level or lift up moulds to stack them at a high level. The moulds may thus be supplied at a particular height along a conveyor and stacked in the frame at the same height.

The upper and lower mould sections may either be assembled before stacking in the frame or the lower section may be stacked first and the upper section stacked on top of it in the frame. When the mould is to contain cores, these may be inserted either before or during stacking.

Once the required number of moulds have been stacked in the frame they are then secured. For this purpose the plate 7 is placed over the uppermost mould and secured in position by rotating the sleeves 16 to cause the rods 12 and hence the plate 7 to be drawn downwards. The provision of the flanges 6 and the slots which receive them allows the plate to adjust to the correct level.

Figure 2:
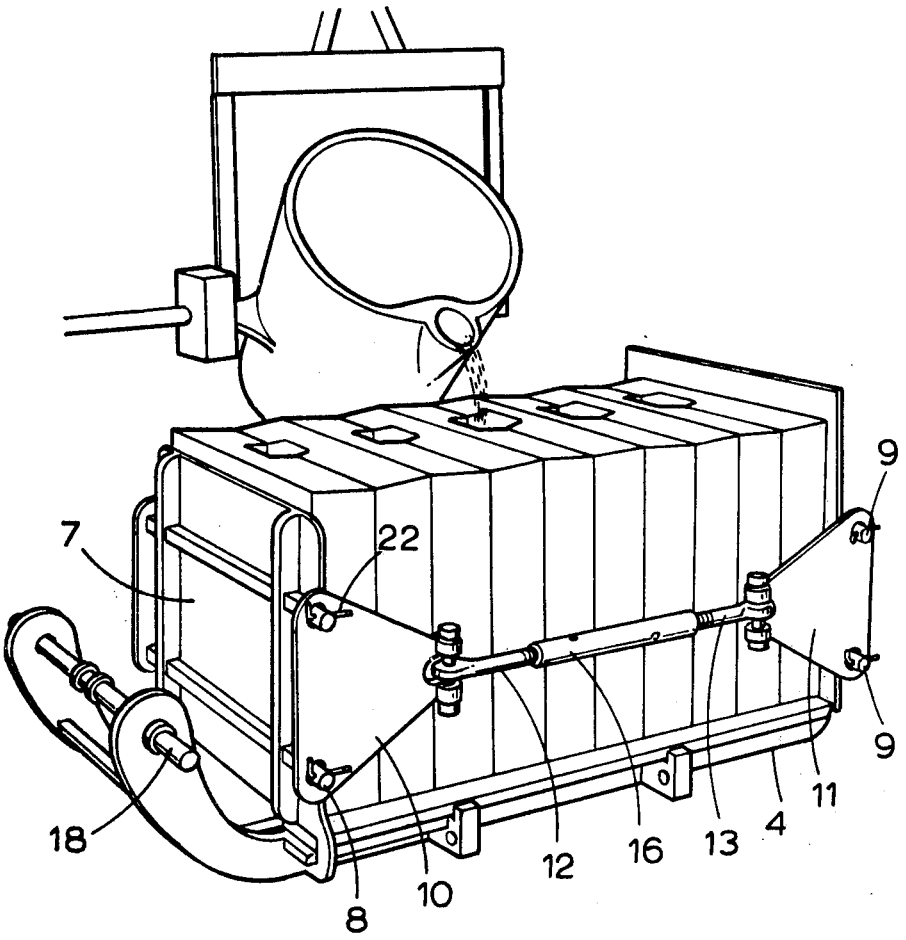
FIG. 2 is a perspective view of the apparatus turned through 90° from the position of FIG. 1 during pouring of molten metal into the moulds.

When the moulds have been thus secured the frame containing the moulds is raised by the crane from the pit 21 to the position illustrated in FIG. 1, moved away from the pit, and tilted through approximately 90° so that it is approximately horizontal and lying on the ground. The moulds will thus be oriented so that they are approximately vertical. The tilting of the frame may be carried out under the control of the, for example, crane.

Casting is then carried out by pouring molten metal individually into moulds, as shown in FIG. 2, or through a gate into a channel which feeds all the moulds and which is defined by aligned passages in the moulds. If the frame is slightly tilted the moulds can be cast separately, molten metal being fed into the above-mentioned channel at the lower end.

Once all the moulds have been filled the metal is allowed to cool. The plates 10 and 11 and their associated rods 12 and 13 can then be removed from the side of the frame visible in FIG. 1, and having first rotated the connecting sleeve 16 to loosen the grip of the plate 7 on the top of the stack of moulds. The plate 7 can also be removed by lifting from the upright portion 2 of the frame, for example by a crane provided with chains which are passed round the pins 8. The frame is then tilted about a longitudinal axis thereof, for which purpose also chains attached to a crane may be used, to cause the moulds with the casting thereon to fall out of the frame sideways. The castings are then separated from the mould material.

It will be appreciated that various modifications may be made to the example of the invention described herein. For example, instead of using a crane to effect lifting, lowering and tilting of the frame, a hydraulic system secured to the frame could be employed.

I claim:

1. A method of casting utilizing boxless molds, the method comprising the steps of:

(1) conveying molds at a first level to a frame maintained in a vertical position, the frame comprising a lower support surface for molds and a rear abutting plate, the lower support surface being initially substantially at the first level;

(2) stacking a plurality of boxless molds one on another in the frame to form a substantially vertical stack, each mold being in a substantially horizontal position and abutting against the rear plate;

(3) lowering the frame into a pit therebeneath during stacking of the molds on the frame, so as to maintain the top surface of the uppermost mold substantially at the first level;

(4) lifting said frame from said pit and securing the molds within the frame, then pivoting the frame with the molds therein to an angle of approximately 90° so that each mold stands substantially vertically, the molds resting upon the abutting plate; and (5) filling the molds with molten metal while maintaining the molds in the substantially vertical position.

2. A method according to claim 1, wherein the moulds are filled individually.

3. A method according to claim 1, wherein the moulds are filled together via a feeder channel.

4. A method according to claim 1 wherein each of said moulds includes a plurality of mould sections.

5. A method according to claim 4 wherein said mould sections are assembled prior to the step of stacking said moulds.

6. A method according to claim 4 wherein said mould sections are assembled to form said moulds with said step of stacking said moulds.

* * * * *